United States Patent [19]

Mihaita

[11] Patent Number: 4,967,642

[45] Date of Patent: Nov. 6, 1990

[54] MACHINE GUN

[76] Inventor: Ion Mihaita, 1369 W. 85th St., Cleveland, Ohio 44102

[21] Appl. No.: 404,321

[22] Filed: Sep. 8, 1989

Related U.S. Application Data

[63] Continuation-in-part of Ser. No. 310,700, Feb. 14, 1989, abandoned.

[51] Int. Cl.[5] ..... F41D 11/02; F41C 21/18

[52] U.S. Cl. ..... 89/126; 89/14.2; 89/14.3; 89/127

[58] Field of Search ..... 89/126, 127, 1.41, 14.3, 89/14.4, 14.2

[56] References Cited

U.S. PATENT DOCUMENTS

| | | | |
|---|---|---|---|
| 817,134 | 4/1906 | Smith | 89/14.3 |
| 1,202,707 | 10/1916 | Grieco | 89/126 |
| 1,446,635 | 2/1923 | Berthier | 89/127 |
| 1,477,115 | 12/1923 | Gast | 89/126 |
| 2,041,015 | 5/1936 | Onorati | 89/1.41 |
| 2,167,495 | 7/1939 | Wimmersperg | 89/126 |
| 2,206,568 | 7/1940 | Hughes | 89/14.3 |
| 2,410,848 | 11/1946 | Waltke | 89/126 |
| 2,436,175 | 2/1948 | Neal | 89/127 |
| 2,804,709 | 9/1957 | Hughel et al. | 42/42.01 |
| 2,899,866 | 8/1959 | Clark et al. | 89/127 |
| 2,935,915 | 5/1960 | Janson | 89/126 |
| 2,972,286 | 2/1961 | Marquardt | 89/127 |
| 2,976,770 | 5/1961 | Fletcher | 89/126 |
| 3,131,499 | 5/1964 | Arsenault | 42/42.01 |
| 3,141,376 | 7/1964 | Chinn | 89/14.3 |
| 3,442,173 | 5/1969 | Muller | 89/127 |
| 3,564,949 | 2/1971 | Hedrick | 42/100 |
| 3,710,683 | 1/1973 | Kaltmann | 89/14.3 |
| 3,861,069 | 1/1975 | Heurlén | 42/42.01 |
| 3,950,875 | 4/1976 | Hirschfeld | 42/42.01 |
| 4,697,496 | 10/1987 | Goldin | 89/127 |
| 4,766,800 | 8/1988 | Miller et al. | 42/100 |
| 4,867,039 | 9/1989 | Dobbins | 89/127 |

*Primary Examiner*—David H. Brown

*Attorney, Agent, or Firm*—Fay, Sharpe, Beall, Fagan, Minnich & McKee

[57] ABSTRACT

A fire arm includes a body and a handle carried thereby as well as first and second barrels secured to the body. The second barrel is secured below the first barrel. A first loading mechanism is located in the body for loading the first barrel and a second loading mechanism is loacted in the body for loading the second barrel. A first magazine is selectively secured to the body for supplying the first loading mechanism and a second magazine is selectively secured to the body for supplying the second loading mechanism. The second magazine is spaced from the first magazine. A firing mechanism, which is located in the body allows a sequential firing of the first and second barrels.

19 Claims, 10 Drawing Sheets

MACHINE GUN

BACKGROUND OF THE INVENTION

This application is a continuation-in-part of application Ser. No. 310,700 filed on Feb. 14, 1989, now abandoned.

This invention relates to firearms. More specifically, the present invention relates to a double barreled firearm which is selectively automatically repeating and in which single barreled operation can be chosen if desired.

The invention will be specifically described in relation to a submachine gun utilizing upper and lower barrels fed by two separate magazines which are spaced from each other. It should be recognized, however, that various aspects of the invention could also be utilized in other types of firearms such as pistols, rifles, shot guns, and the like.

While there have been many automatic firearms of various sorts, each has had its disadvantages. Attempts have been made heretofore to design automatic firearms having parallel barrel systems which are coupled together in such a manner that they will fire alternately. Attempts have also been made to allow either a single barreled or double barreled operation of such weapons. However, the need still remains for a double barreled machine gun which has a wide range of firing characteristics but is simple to operate, can be braced against the user and has sighting capabilities.

Accordingly, it has been considered desirable to develop a new and improved firearm construction which would overcome the foregoing difficulties and others and meet the above-stated needs while providing better and more advantageous overall results.

BRIEF SUMMARY OF THE INVENTION

In accordance with the present invention, a new and improved firearm is provided.

More particularly, in accordance with this aspect of the invention, the firearm comprises a body and a handle carried thereby as well as first and second barrels secured to the body. The second barrel is secured below the first barrel. A first loading mechanism is located in the body for loading the first barrel and a second loading mechanism is located in the body for loading the second barrel. A first magazine is selectively secured to the body for supplying the first loading mechanism and a second magazine is selectively secured to the body for supplying the second loading mechanism. The second magazine is spaced from the first magazine. A firing mechanism, which is located in the body allows a sequential firing of the first and second barrels.

According to another aspect of the invention, a machine gun is provided.

According to this aspect of the invention, the machine gun comprises a body including a handle at one end and first and second barrels secured to the body. First and second firing mechanisms are located in the body in operative connection with the first and second barrels respectively. First and second magazines are selectively secured to the body for supplying ammunition to the first and second firing mechanisms respectively. A first control mechanism is located in the body for adapting the machine gun for selective automatic and semi-automatic operation. A second control mechanism is located in the body for adapting the machine gun for selective firing from both of the first and second barrels and from one of the first and second barrels.

One advantage of the present invention is the provision of a new and improved firearm.

Another advantage of the present invention is the provision of a submachine gun which has upper and lower barrels fed by separate magazines which are spaced from each other to give the gun better balance.

Still another advantage of the present invention is the provision of a two barreled firearm with a control mechanism which allows either both barrels to be fired or one barrel to be fired individually, as desired.

Yet another advantage of the present invention is the provision of a firearm in which a selector mechanism allows the firearm to be prevented from operation as well as to operate in a semi-automatic mode, and in an automatic mode.

A further advantage of the present invention is the provision of a firearm which has front and rear sights, each of which is adjustable and in which the rear sight can be set for different distances. The rear sight is also provided with a central aperture and a plurality of surrounding side apertures to allow for greater visibility by the user.

A still further advantage of the present invention is the provision of a firearm which has a folding stock that can be locked in either a stowed position or a use position.

A yet further advantage of the present invention is the provision of a multiple barreled firearm with a recoil compensating muzzle secured to the free end of each barrel.

An additional advantage of the present invention is the provision of a submachine gun having a rear grip and a front grip and in which the front grip can be either perpendicular to the body of the gun or located at an angle to the body of the gun. In both of these constructions the front grip is in the same plane as rear grip. In yet another construction, the plane of the front grip is spaced at 90° from the plane of the rear grip.

Still other benefits and advantages of the present invention will become apparent to those skilled in the art upon a reading and understanding of the following detailed specification.

BRIEF DESCRIPTION OF THE DRAWINGS

The invention may take physical form in certain parts and arrangements of parts preferred and alternate embodiments of which will be described in detail in this specification and illustrated in the accompanying drawings which form a part hereof and wherein.

DETAILED DESCRIPTION OF THE PREFERRED AND ALTERNATE EMBODIMENTS

Figures 1, 1A:
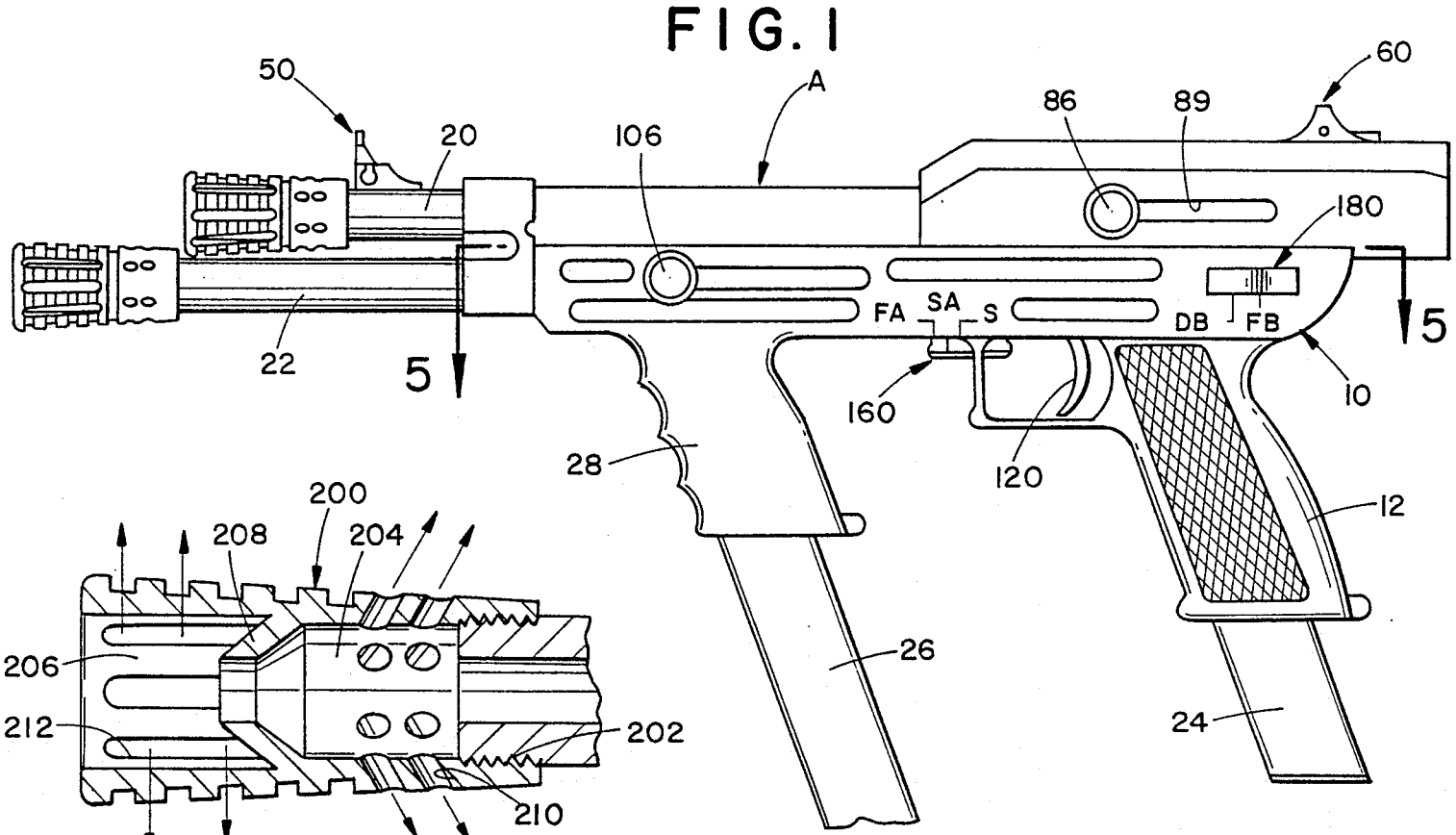
FIG. 1 is a left hand side elevational view of a firearm according to a first preferred embodiment of the present invention.
FIG. 1A is a greatly enlarged cross-sectional view of a recoil compensating muzzle of the firearm of FIG. 1.

Referring now to the drawings wherein the showings are for purposes of illustrating preferred and alternate embodiments of the invention only and not for purposes of limiting same, FIG. 1 shows a preferred embodiment of the subject new firearm. While the firearm is primarily designed as and will hereinafter be described as a submachine gun, it will be appreciated that the various control mechanisms of the overall inventive concept could also be adapted for use in many other firearm environments for, e.g., pistols, rifles and the like.

More particularly, the machine gun A includes a body 10 having a handle or rear gun grip 12. Secured to the body are upper and lower barrels 20 and 22 which are located in an over and under relationship. A first or rear magazine 24 extends into the handle 12 and supplies the upper or first barrel 20 with a suitable type of ammunition. The ammunition can be, e.g., 38 caliber or 9 mm or the like depending upon the size of the barrels and loading mechanisms, etc. provided for the machine gun. Also provided is a front magazine 26 which extends into a front grip 28 disposed in a spaced relationship to the rear grip 12. This spaced relationship gives the gun better balance. The second or front magazine 26 supplies the lower or second barrel 22 with ammunition. Preferably the magazines 24 and 26 each hold approximately thirty six bullets.

Figure 9:
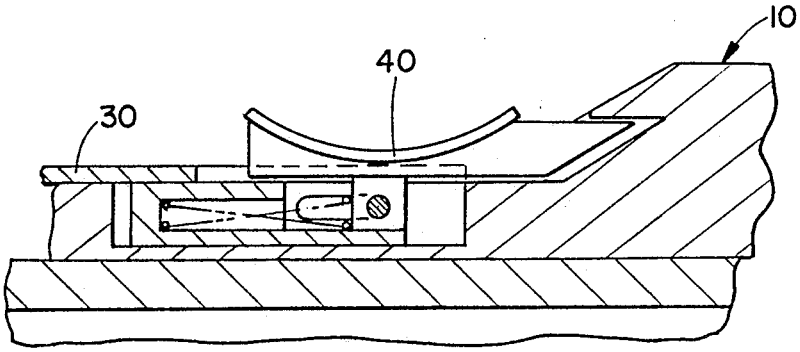
FIG. 9 is an enlarged cross-sectional view of a front lock mechanism for a foldable stock of the firearm of FIG. 1.
Figures 14, 15:
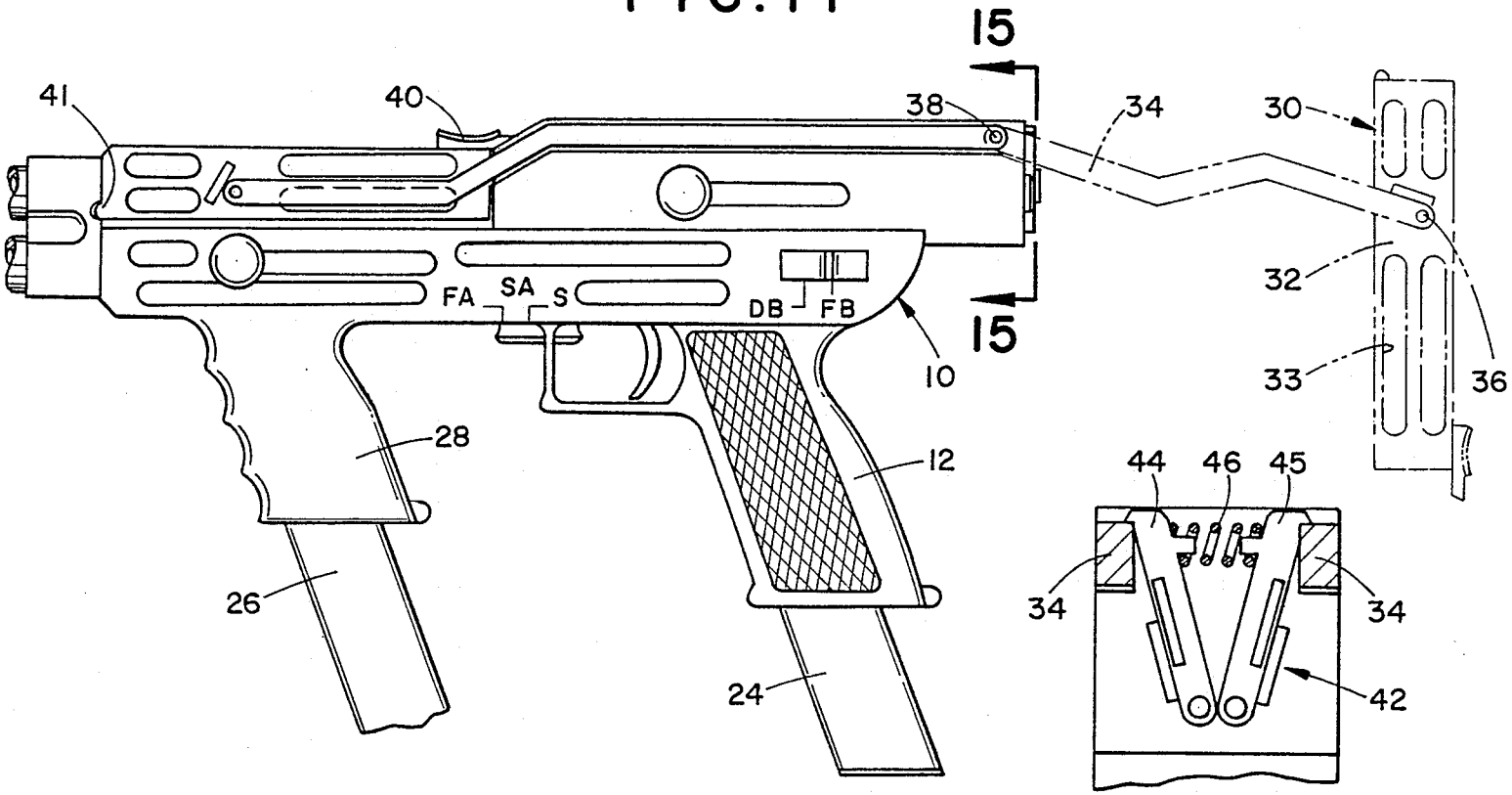
FIG. 14 is an enlarged view of a rear section of the firearm of FIG. 1 illustrating a foldable stock secured thereto.
FIG. 15 is a greatly enlarged view of a rear lock mechanism for the foldable stock of FIG. 14 along line 15—15.

With reference now to FIG. 14, disposed in a pivotable relationship to the body 10 is a folding stock 30 which allows the gun to be braced against a user's body if desired. The stock 30 comprises a substantially U-shaped body section 32 which includes a plurality of cutouts 33 in order to allow the stock to be light yet strong since it is preferably made of a suitable metal. Additionally, the cutouts are advantageous since when the stock is secured to the gun body 10, it allows the gun to better radiate away heat generated during the firing process. The stock 30 is pivotably mounted on a pair of spaced parallel arms 34 by a swivel 36. The arms 34 are in turn pivotably mounted to the gun body at a swivel 38. The two swivels allow the stock 30 to be adjusted to fit the needs of the user. Securing the folding stock in a locked position against the gun body is a lock member 40 which is best illustrated in FIG. 9. Also provided at a forward end of the stock 30 are tabs 41 which fit in suitable indentations of the body 10 to secure the stock against movement when fastened to the gun body.

In order to secure the folding stock in the use position, a second locking mechanism 42 is provided at the rear of the body 10 as best seen in FIG. 15. The lock mechanism comprises a pair of locking levers 44 and 45 which are biased away from each other by a spring 46 and into engagement with the arms 34. When the levers 44, 45 and pushed towards each other, the arms 34 can be pivoted so that the stock can be again stowed away.

Figure 11:
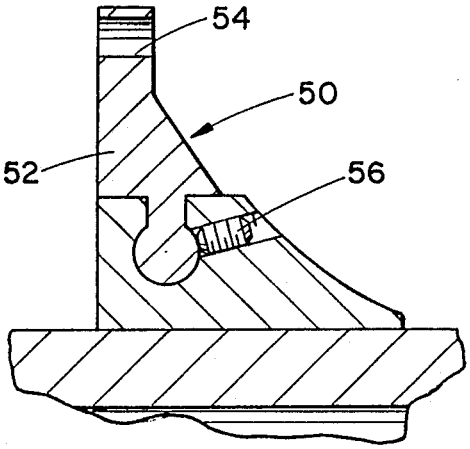
FIG. 11 is a side elevational view of the front sight of FIG. 10.
Figure 10:
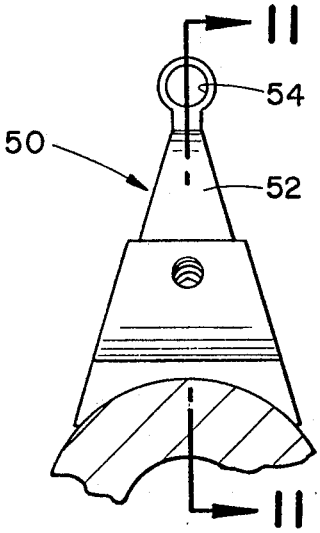
FIG. 10 is a greatly enlarged front elevational view of a front sight of the firearm of FIG. 1.

With reference now also to FIGS. 10 and 11, provided on the upper or first barrel 20 is a first or front sight 50 having a sight body 52 as well as an aperture 54 through which the user views the target. The front sight is adjustable in a direction normal to the longitudinal axis of the barrel 20 and can be secured in place by use of a suitable screw 56.

Figure 13:
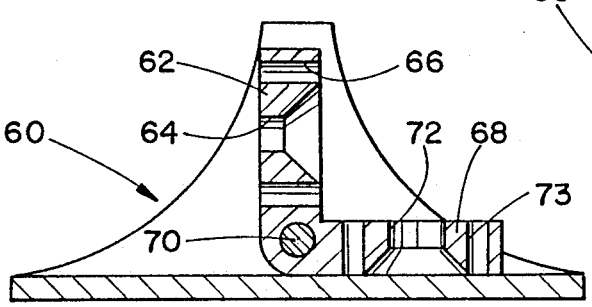
FIG. 13 is a side view in cross-section of the rear sight of FIG. 12.
Figure 12:
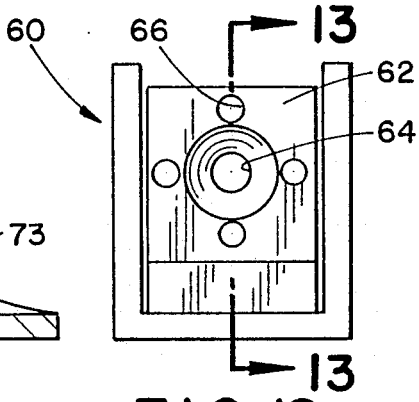
FIG. 12 is a greatly enlarged front elevational view of a rear sight of the firearm of FIG. 1.

Spaced from the front sight 50 is a rear sight 60 which can best be seen in FIGS. 12 and 13. The rear sight has a first body section 62 which includes a central through aperture 64 as well as a plurality of spaced side apertures 66. Preferably, four such apertures 66 are provided in a cruciform shaped pattern. The purpose of the side apertures is to improve the visibility of the target to the gun user when using the sight. The central aperture 64 may be configured to work best at, e.g. 100 m. In order to allow the user of the gun to employ the sight at another distance, an integral second body section 68 can be provided. The sight body can be pivotable around a pivot point 70. In this way, once the body is pivoted so that the second body section 68 is now perpendicular to the axis of the first barrel 20, a second central aperture 72 is now visible to the user. This aperture is designed for use at a different distance than the first central aperture 64, e.g., 200 m. A plurality of side apertures 73 may be disposed around the central aperture, as with the side apertures 66, in order to improve the visibility of the target through the sight.

Figure 2:
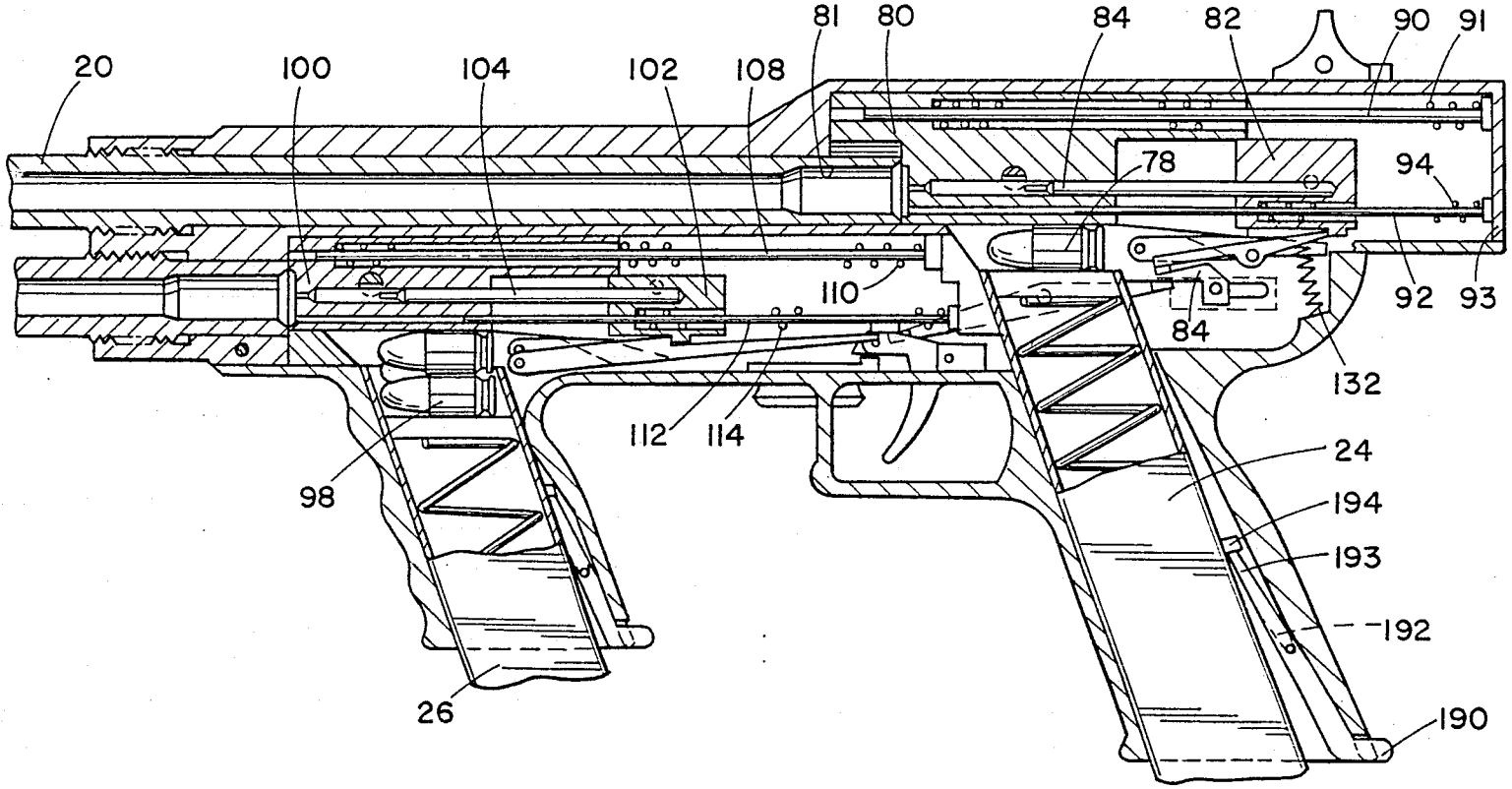
FIG. 2 is an enlarged cross-sectional view through a portion of the firearm of FIG. 1.
Figure 6:
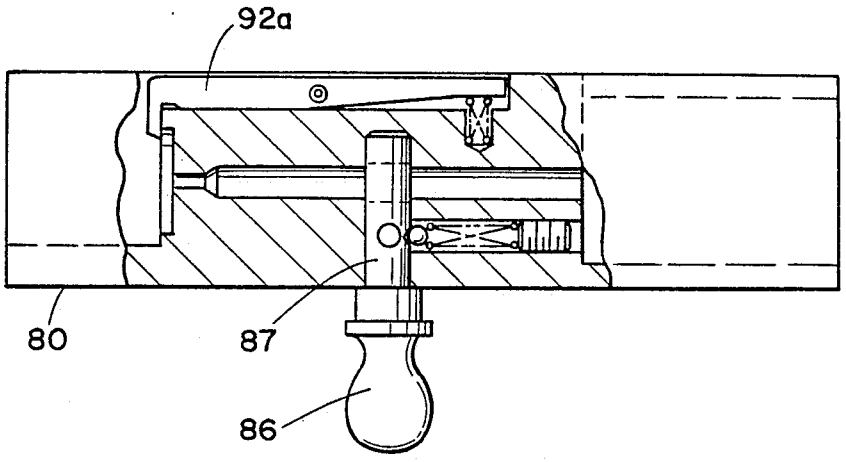
FIG. 6 is a top plan view of a bullet receiver section of the firearm of FIG. 1 in partial cross-section.
Figure 7:
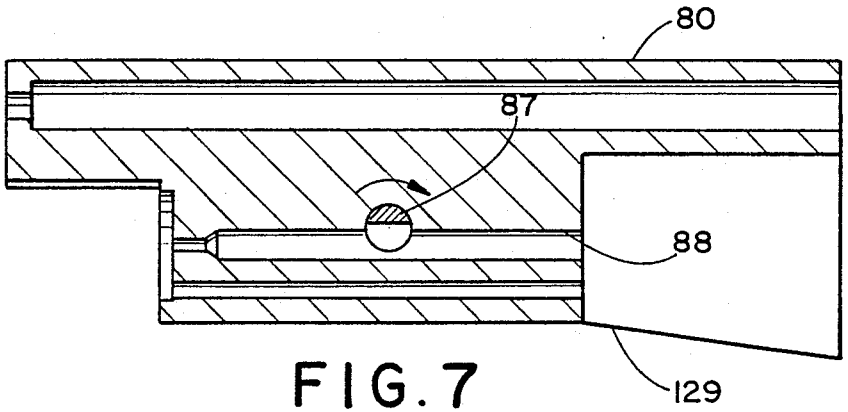
FIG. 7 is a side elevational view of the bullet receiver of FIG. 6 in cross section.

With reference now to FIG. 2, a suitable bullet 78 can be fed from the rear magazine 24 to the upper barrel 20 by means of a first loading mechanism including a first bullet receiver 80 which is adapted to slide in a horizontal plane. When the bullet receiver slides to the rear from the position illustrated, the bullet can be inserted into a suitably configured rear end 81 of the first barrel 20. Adapted to cooperate with the first bullet receiver 80 is a firing mechanism including a first striker block 82 to which is secured a first striker pin 84. The operation of the striker block 82, and hence the movement of the striker pin 84 is controlled by a first operating handle 86 which is best seen in FIG. 6. The rotation of this handle will selectively interpose a semicircular rod section 87 in a bore 88 through which the striker pin reciprocates. When the rod section is rotated out of the way (as shown in FIG. 7), the striker pin 84 is allowed to move forwardly in the bore 88 of the bullet receiver 80 so that it can impact a rear section of the bullet 78.

The first bullet in each barrel 20, 22 is fired manually, whereas all of the following ones are fired automatically. In order to fire the first bullet 78 through the upper barrel 20, the operating handle 86 must be pushed toward the rear along its slot 89 as best seen in FIG. 1.

This action moves the bullet receiver 80 toward the rear and, in effect, cocks the gun.

Figure 8:
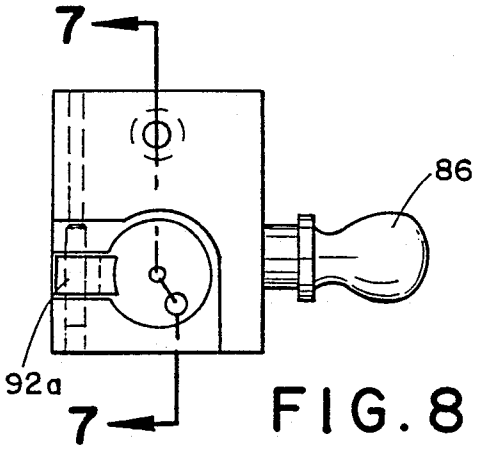
FIG. 8 is a front view of the bullet receiver.

The movement of the operating handle 86 allows the initial bullet 78 to enter the gun area behind the first barrel 20 so that the bullet receiver 80 can move the bullet forward into the barrel 20. Guiding the sliding movement of the first bullet receiver 80 is a first guide rod 90. Biasing the bullet receiver in a forward direction is a suitable recoil spring 91 which is mounted on the guide rod 88. It is against the biasing movement of the spring 91 that the first operating handle 86 moves the bullet receiver 80 toward the rear of the gun body 10. Guiding the movement of the striker block 82, and also serving to eject the spent casings from the gun after the gun has been fired is a second or ejector rod 92 which is spaced from the first or guide rod 88 and is parallel therewith. The spent casing ejection port of the firearm is not visible in the FIGURES. However, an extractor member 92*a* which cooperates with the ejector rod 92 for this purpose is visible in FIGS. 6 and 8. Both rods 90 and 92 are secured to a rear wall 93 of the body 10. Serving to bias the striker pad 82 in a forward direction is a second or compression spring 94 which is mounted on the second rod 92.

Figure 3:
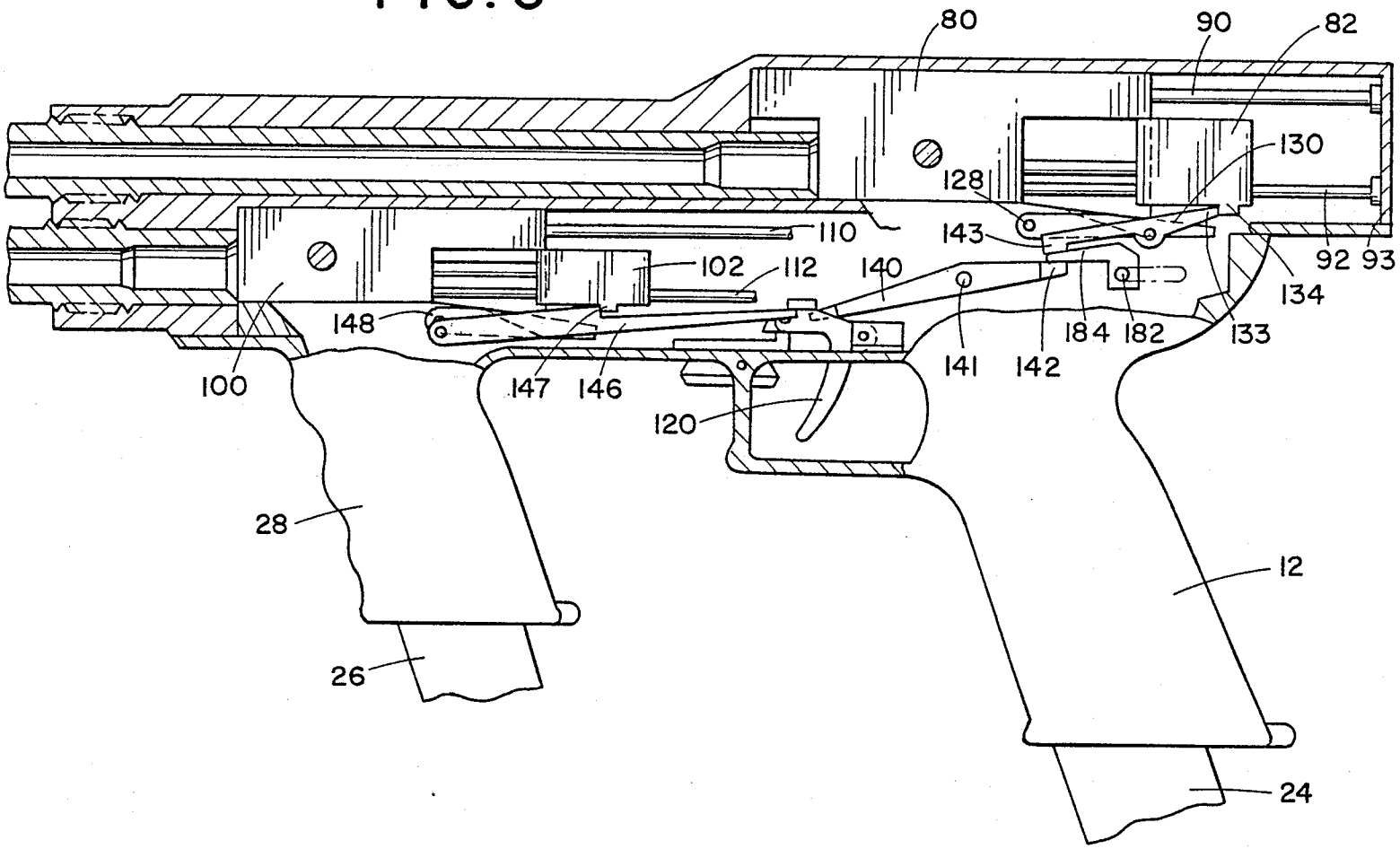
FIG. 3 is an enlarged cross-sectional view of a portion of the firearm of FIG. 2 with certain parts broken away for clarity.

A second loading mechanism is provided in the gun body to load suitable ammunition 98 to the lower barrel 22. The second loading mechanism is identical to the first loading mechanism so it will only be described briefly, it being understood that it functions in the same manner as does the first loading mechanism described hereinabove. As also shown in FIG. 3, the second loading mechanism includes a second bullet receiver 100. A second firing mechanism includes a second striker block 102 to which is secured a second striker pin 104. A second operating handle 106, which can be best seen in FIG. 1, selectively allows the forward movement of the second striker pin 104 and allows the second bullet receiver to be initially pulled to the rear. A third guide rod 108 guides the forward and rearward movement of the second bullet receiver 100. A third or recoil spring 110 is positioned on the guide rod 108 in order to bias the bullet receiver 100 in a forward position. A fourth or ejector rod 112 guides the movement of the second striker block 102 as well as ejects spent cartridges from the gun. A fourth or compression spring 114 which is mounted on the fourth rod 112 biases the second striker block 102 in a forward direction.

Figure 4:
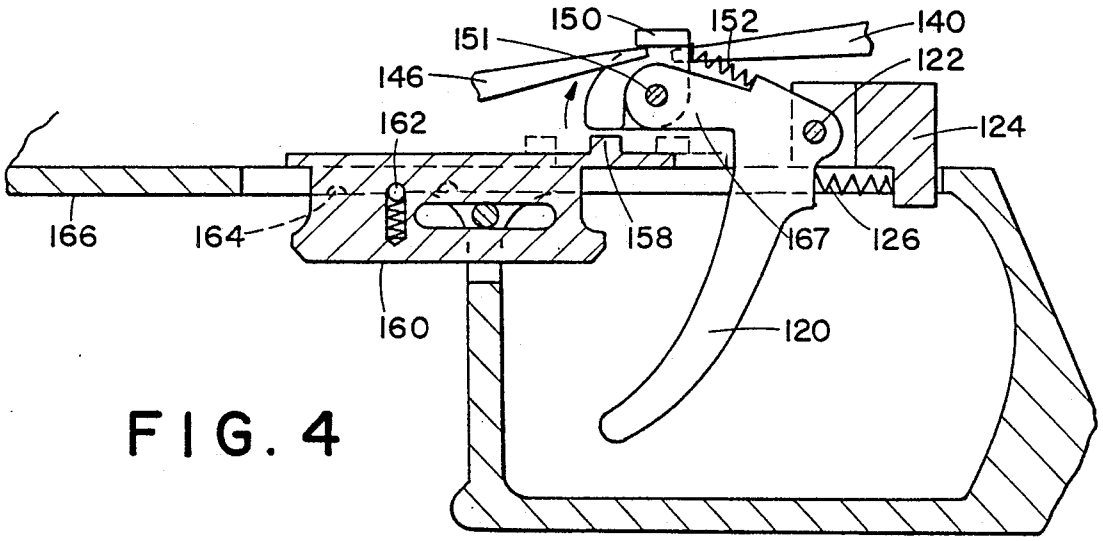
FIG. 4 is a greatly enlarged cross-sectional view of a portion of the firearm of FIG. 3.

With reference now to FIG. 4, a trigger 120 controls the operation of the first and second firing mechanisms. The trigger 120 is pivotable around a pivot point 122 which is secured to a trigger support block 124 that is mounted in a stationary manner on the body 10. A trigger spring 126 resiliently biases the trigger 120 in a clockwise direction around the pivot point.

Operating to control the forward movement of the first striker block 82 is a sear cam 128 which is pivotably mounted to the body 10 below the first striker block 82 as shown in FIG. 3. The purpose of the sear cam 128 is to prevent a firing of the gun by blocking a forward movement of the striker block 82 if the bullet receiver 80 is not in its forwardmost position. The sear cam is normally biased upwardly around its pivot point by a spring (not visible). As the bullet receiver 80 travels forwardly, however, a contact surface 129 thereon (best seen in FIG. 7) will push the sear cam 128 down and disengage it from the striker block 82.

A first sear lever 130 which is biased in an upward direction by a first sear spring 132 (see FIG. 2) will also block a forward movement of the striker pad 82. In other words, a rear tip 133 of the sear lever 130 contacts a shoulder 134 of the striker block 82, as shown in FIG. 3, in order to prevent the striker block from sliding forwardly as biased by the second spring 94.

Acting to pivot the first sear lever 130 out of the way in order to allow the first striker block 82 to move in a forward direction is a linkage member 140 which is pivotably fixed at 141 to the body 10. A rear end 142 of the member will thus act on a front end 143 of the first sear lever 130 thereby pivoting the lever around pivot point 131 thus releasing the first striker block 82. The linkage member 140 is operatively connected to a front section of the trigger 120. The trigger is also connected to the firing mechanism of the second barrel by a second sear lever 146. This sear lever cooperates with a flange section 147 of the second striker block 102. Also provided is a second sear cam 148 and a second spring (not visible).

In order to allow an automatic operation of the gun, the flow back principle has been adopted such that the recoil of the firing of the bullet in the barrel 20 will push the upper barrel bullet receiver 80 to the rear against the bias of the spring 90 to allow another cartridge 78 to enter the upper barrel 20. The same operation occurs for the lower barrel as the gas exhaust will push the second barrel bullet receiver 100 to the rear against the bias of the spring 110 and allow a cartridge 98 to enter the barrel 22.

With reference again to FIG. 4, the trigger 120 also has a lever portion 150 which is pivotably mounted at 151 and is biased in a counterclockwise direction by a compression spring 152. The lever 150 is adapted to cooperate with a heel member 158 of a selector block 160. The block 160 has positioned therewithin a spring biased ball member 162 which cooperates with a plurality of detents 164 provided on a bottom wall 166 of the gun body. In other words, the selector block can be moved longitudinally along the bottom wall 166 toward and away from the trigger 120 into three positions. A forward position is a fully automatic firing mode of the submachine gun, a center position, in which the ball 162 is illustrated, is a semi-automatic mode and a rearward position is a safety position which prohibits all firing of the gun. To this end, in the safety position, when the trigger 120 is pulled, a forward section 167 thereof will attempt to pivot counterclockwise around pivot point 122 but will hit the heel member 158 of the selector 160 thereby preventing the trigger from being pulled. The second sear lever 146 and the selector arm 140 will thus not move. The spring biased ball 162 keeps the selector block 160 in the desired position.

In other words, When the selector block 160 is closest to the trigger, the gun cannot be fired since the trigger forward section 167 will be stopped by the selector block heel 158. When the selector is in a semi-automatic mode, then pulling the trigger 120 causes the spring loaded lever 150 to contact the selector block heel 158 causing the spring loaded lever 150 to pivot in a clockwise direction around pivot point 151 against the bias of spring 152. This allows the second sear lever 146 to release the second striker block 102 and the first sear lever 130 to release the first striker block 82. However, since the lever 150 has now been rotated, further firing of the gun is prevented unless the trigger 120 is released so that the lever can reset.

When the selector 160 is in the forward or fully automatic position, pulling the trigger 120 causes the second sear lever 146 to release the second striker block 102 and causes the linkage member 140 to pivot in a counterclockwise direction thereby impacting the rear end 143 of the first sear lever 130 thus causing that sear lever 132 to pivot in a clockwise direction thereby releasing the first striker pad 82. Since the lever 150 has not been pivoted, further firing of the gun is allowed.

Due to the blow back of the exhaust gases caused by the firing, and the counteracting action of the respective springs 90 and 110, the two bullet receivers 80 and 100 are reciprocated thereby causing automatic firing of the weapon as long as the trigger is pulled. When the trigger is so held, the trigger block heel 158 is not contacted by either the lever 150 or the trigger forward section 167 at all as long as the selector 160 is in the automatic position.

As best shown in FIG. 4, the two sear cams 128 and 148 are positioned beside their respective sear levers 130 and 146. Similarly, the second sear lever 146 and the linkage member 140 are spaced apart in such a relationship that both can be acted on by the lever 150. When the trigger 120 is pulled, the sear lever 130 disconnects the second striker block 102 and allows the spring 114 to bias the striker block forward thereby allowing the striker pin 104 to impact a rear of a bullet 98 positioned in the lower barrel 22. This enables that barrel to fire the bullet. Simultaneously therewith, the trigger also allow the linkage member 140 to pivot and thereby impact on the first sear lever 130 thus allowing that sear lever to pivot against the biasing action of its spring 132 and disconnect the first striker block 82. This allows the striker block then to be pushed forward by its spring 94. This then allows the first striker block 82, and hence the striker pin 84 to advance in its channel 85 until it impacts a rear section of a cartridge 78, thereby firing the upper barrel 20. Because of the length of the linkage member 140 and its need to cooperate with the first sear lever 132, the lower barrel 22 will fire first when the trigger 120 is pulled and only subsequently will the upper barrel 20 fire. This construction allows a sequential firing of the gun.

Figure 5:
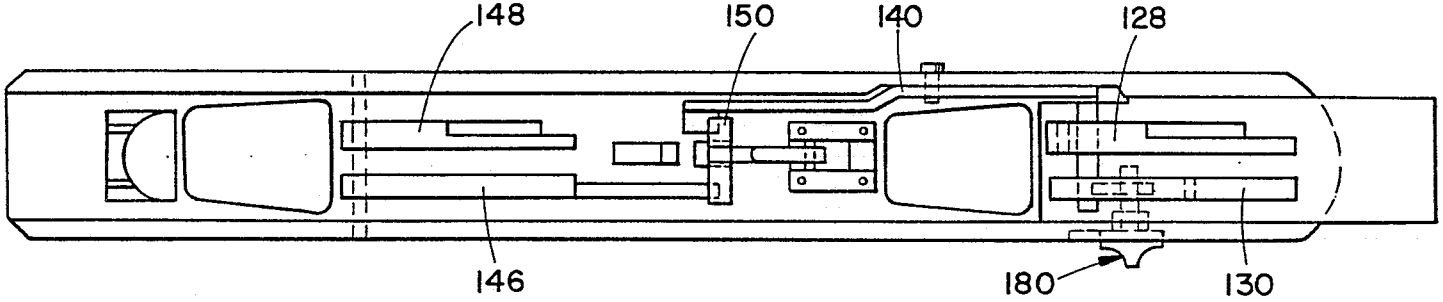
FIG. 5 is a top plan view of a lower stock section of the firearm of FIG. 1 along line 5—5.
Figure 18:
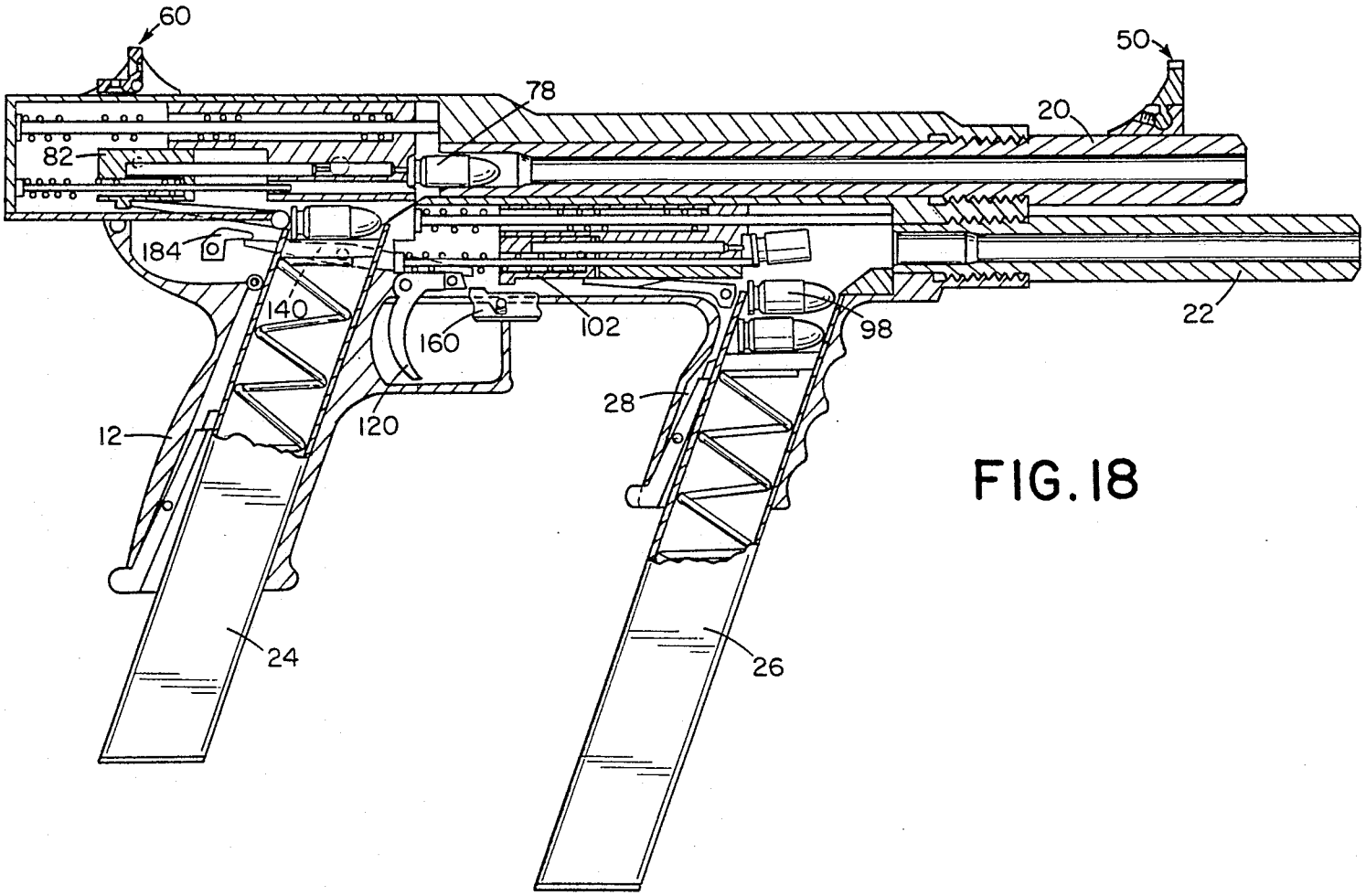

With reference now also to FIG. 18, the loading of the bullets 78 and 98 is on a timing feed from the blocks 82 and 102 which allows the user to balance and control the firearm when firing. As shown in FIG. 18, while a bullet 78 is loaded into one barrel 20 of the gun a spent causing is being ejected from the other barrel 22 of the gun is ejecting a spent casing. In other words, the sequential firing of the gun is, in part, caused by the sequential loading of the two barrels 20 and 22 by the two separate loading blocks 82 and 102. With reference now to FIG. 3, when the trigger 120 is pulled, a rear end of the forward sear lever 146 is rotated downwardly by the trigger lever portion 150. This allows the forward sear lever 146 to release the forward striker block 102 thereby firing the bullet 98 once it is impacted by the forward striker pin 104. As shown in FIG. 5, rotation of the lever 140 in a counterclockwise direction will also cause the linkage member 140 to pivot in a counterclockwise direction. The pivoting motion of the linkage member 140 enables a tripping of the rear sear lever 130 causing that lever to rotate around its pivot point, thereby allowing the upper striker block 82 to move in a forward direction enabling the striker pin 84 to impact the bullet 98 housed in the upper barrel 20.

It should be evident that after the forward sear lever 146 disengages from the forward block 102 a certain amount of time is necessary for the various motions which need to be engaged in by the linkage member 140, the arm 184 and the upper sear lever 130 before the sear lever 130 disengages from the upper block 82. In this regard it is noted that the spacing from the trigger 120 to the forward block 102 is on the order of 1½ inches, whereas the spacing from the trigger 120 rearwardly to the upper block 82 is on the order of 2½ inches. This difference in spacing also adds to the time difference between the firing of the lever 22 and upper 20 barrels. The gap of time between the firing of the upper and lower barrels 20 and 22 is on the order of 0.5 seconds to 1 second.

Also provided on the firearm is a selector 180 (see FIG. 1) which enables either a single barreled or double barreled firing of the gun. As shown in FIG. 3, the selector 180 includes a body 182 having a pivotable arm 184. The body 182 is adapted to slide forward and backward. When the body is in a forward position as illustrated in FIG. 3, the arm 184 is located adjacent the linkage member 140 thereby allowing the linkage end 142 to communicate a pivoting motion to the rear end 143 of the first sear lever 130. In this way, the sear lever 130 can pivot, thus releasing the first striker block 82. Accordingly, the upper barrel is allowed to fire. However, when the body 182 is slid backwardly, the arm 184 is spaced away from the selector arm 140. The linkage end 142 is thereby prevented from communicating its pivoting motion, through the selector pivoting arm 184, to the first sear lever 130. This prevents the sear lever 130 from pivoting and thus releasing the first striker block 82. Accordingly, the upper barrel is prevented from firing and only the lower barrel is allowed to fire.

Suitable holding means are provided in order to hold each of the magazines 24 and 26 in position. With reference again to FIG. 2 The holding means for the first magazine 24 will be described, it being appreciated that the holding means for the second magazine 26 is of identical construction. The magazine 24 is held in place by a holder mechanism 190 which is biased by a suitable spring 192 in order that an upper end 193 of the mechanism cooperates with a flange section 194 provided on a rear surface of the magazine 24. When the magazine 24 is inserted, it just needs to be pressed into place as the flange 194 will pivot the holder 190 out of the way against the bias of the spring 192. When it is desired to detach the magazine, the holder 190 is pushed inwardly against the bias of the spring 192. This will then pivot the holder 190 such that its end 193 is no longer in contact with the flange 194. This will then allow the magazine to be withdrawn.

With reference now to FIG. 1A, a recoil compensating muzzle 200 is provided for each of the barrels 20 and 22. These muzzles or compensators are tubular members which are preferably threaded into place on the barrels such as by threading 202. The recoil compensator has first and second chambers 204 and 206 which are separated by a suitable wall section 208. Provided in the first chamber 204 are a plurality of spaced apertures 210 which extend radially through the compensator 200 and are preferably oriented at an angle of approximately 45° to a longitudinal axis of the compensator. This allows exhaust gases from the firing of the bullet to be discharged out through the plurality of apertures 210 at an angle. Provided in the second chamber 206 are a plurality of longitudinal slots 212 which allow most of the remaining exhaust gases to escape radially away from the recoil compensator 200.

Preferably, six such first apertures 210 are provided in which approximately 45% of the exhaust gases will be released. The second chamber also has preferably six longitudinally extending apertures 212 which release another 50% of the original 100% of gas. Accordingly, the recoil compensator will release approximately 95% of the gas generated in the explosion which propels the bullet out of the gun.

Figure 16:
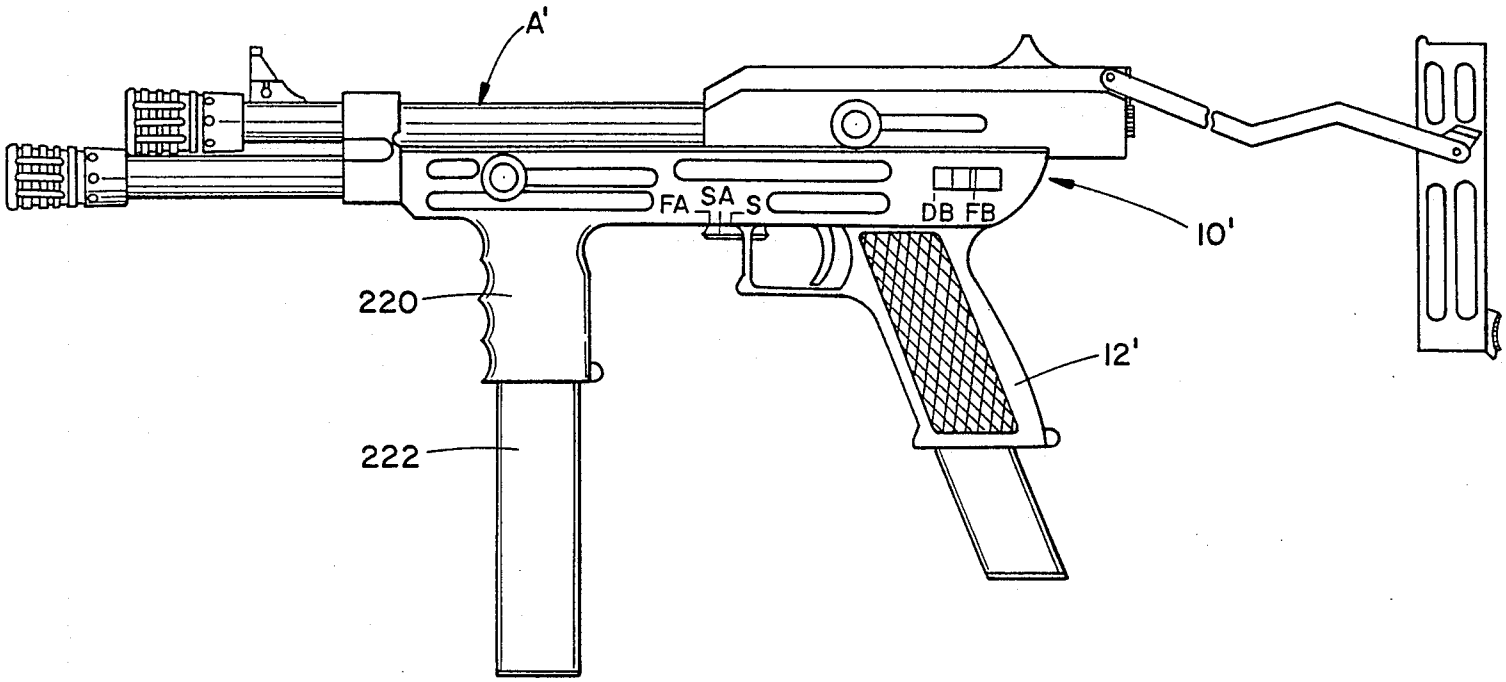
FIG. 16 is a side elevational view of a firearm according to a first alternate embodiment of the present invention; and, FIG. 17 is a side elevational view of a firearm according to a second alternate embodiment of the present invention.

With reference now to FIG. 16, a first alternate embodiment of the invention is there illustrated. For ease of illustration of the first alternate embodiment, like components will be identified with like numerals with a primed (') suffix and new components will be identified by new numerals.

In this embodiment, a machine gun A' is provided with a front grip or handle 220 which extends substantially normal to a longitudinal axis of a machine gun body 10'. A suitable magazine 222 is held in the front grip. The front grip 220 is located in substantially the same plane as is a rear grip 12'.

Figure 17:
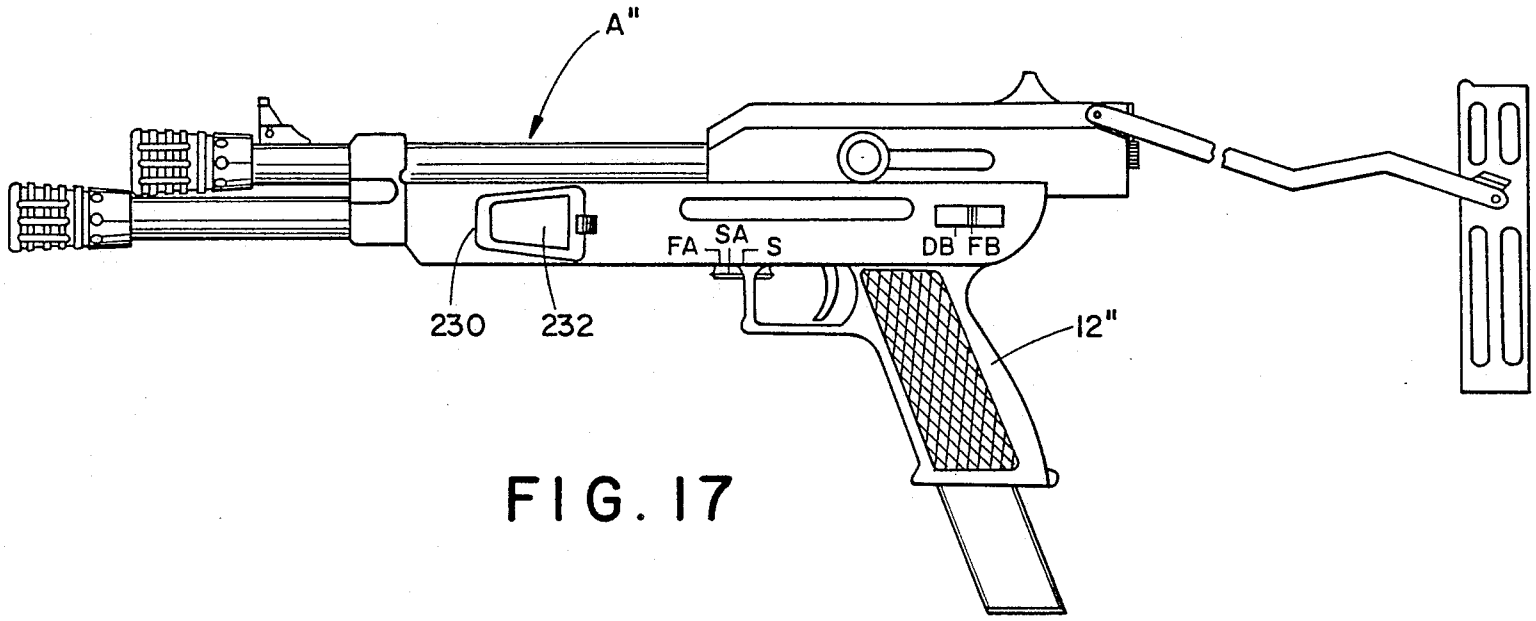

With reference now to FIG. 17, a second alternate embodiment of the invention is there illustrated. For ease of appreciation of this alternative, like components will be identified by like numerals with a double primed (") suffix and new components will be identified by new numerals.

In this embodiment, the machine gun A" is provided with a sideways extending front grip or handle 230 in which a suitable magazine 232 is held. Therefore, in this construction, a rear grip or handle 12" is located in a plane which is oriented at approximately right angles to the plane of the front handle 230.

The construction of this firearm therefore utilizes two barrels which are fed by two separate magazines, one of which is located in a handle or rear pistol grip and the other one of which is located in a forward grip. The firearm has a selector which allows either fully automatic or semi-automatic firing of the gun. The firearm also has a second selector which allows either double barreled or single barreled operation of the gun. The two barrels work together in a timing sequence such that when the trigger is pulled, the first step will be to release the firing pin for the first barrel and then after a period of time, the firing pin will be released for the second barrel, as described above. It should be appreciated that the firearm is provided with a number of different safety features which will prevent it from firing. These include the semi-circular rod section 87 of the operating handle 86, which prevents movement of the firing pin 84; the sear cam 128 and sear lever 130, which each prevent a movement of the firing block 82; and selector 160, which prevents actuation of the trigger 120, when the selector is in the safety position. Also, the gun cannot initially fire unless the operating handle 86 is slid rearwardly so that an initial bullet is received by the bullet receiver 80.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

Having thus described the preferred and alternate embodiments, the invention is claimed as follows:

1. A firearm comprising:

a body and a handle carried thereby;

a first barrel secured to said body;

a second barrel secured to said body;

a first loading mechanism located in said body for loading said first barrel;

a second loading mechanism located in said body for loading said second barrel;

a first magazine selectively secured to said body for supplying said first loading mechanism;

a second magazine selectively secured to said body for supplying said second loading mechanism, wherein said second magazine is spaced from said first magazine;

spaced first and second firing mechanisms which allow a sequential firing of said first and second barrels, said firing mechanisms being located in said body and each comprising a pivotably mounted sear lever which trips a resiliently biased striker block; and, a trigger mechanism comprising:

a finger portion integral with a forward section, a lever portion pivotably mounted on said forward section, said lever portion adapted to contact one end of a first sear lever of said first firing mechanism when said trigger mechanism is pulled, and a linkage member pivotably mounted on said body and having a first end which is adapted to be contacted by said lever portion, and wherein a second end of said linkage member can selectively act on one end of a second sear lever of said second firing mechanism.

2. The firearm of claim 1 further comprising a first control means located in said body for selecting operation of both of said first and second barrels or one of said barrels.

3. The firearm of claim 1 further comprising a second control means located in said body for selecting automatic and semi-automatic operation of the firearm and locking the firearm against operation.

4. The firearm of claim 1 further comprising:

a first sight located on said first barrel; and, a second sight located on said body, wherein both of said sights are adjustable.

5. The firearm of claim 1 further comprising:

a folding stock for supporting the firearm against a body of the user; and, a lock means for locking said folding stock in a first end position and in a second end position, said lock means comprising a first locking member provided on said body and a second locking member provided on said body in a manner spaced from said first locking member.

6. The firearm of claim 1 further comprising a recoil compensator secured to a free end of said first barrel, said recoil compensator comprising a tubular body which includes a longitudinally extending bore and a plurality of spaced radially extending apertures through which gases can escape.

7. A machine gun comprising:

a body including a handle at one end;

first and second barrels secured to said body;

first and second firing mechanisms located in said body and in operative connection with said first and second barrels, respectively each of said firing mechanisms including a pivotable sear lever which acts on a resilient biased striker block;

firs and second magazines selectively secured to said body for supplying ammunition to said first and second firing mechanisms respectively;

a trigger mechanism which actuates said first and second firing mechanisms sequentially wherein said trigger mechanism is a pivotably mounted trigger body comprising:

a finger portion;

a forward flange portion;

a lever portion pivotably mounted on said forward flange portion; and, biasing means for biasing said lever portion to one end position in relation to said forward flange portion;

a first control mechanism located in said body for adapting the machine gun for selective firing from both of said first and second barrels or one of said first and second barrels and comprising a slidable selector body having a pivotable arm, said body, when slid into a first end position will allow said pivotable arm to contact a linkage member to transmit a pivoting motion o f said linkage member to an end of a first sear lever of said first firing mechanism thus allowing a pivoting of said sear lever to release a first striker block of said first firing mechanism, wherein when said slidable selector body is slid into a second end position, said pivotable arm is spaced away from contact with said linkage member to said first sear lever thereby preventing a release of said first striker block and preventing a firing of a first barrel of the machine gun.

8. The machine gun of claim 7 further comprising a folding stock which can be selectively secured in both a stowed position and a use position in relation to said body, wherein located on said folding stock is a sight of the machine gun.

9. The machine gun of claim 7 further comprising a recoil compensating muzzle secured to a free end of said first barrel, said muzzle comprising a tubular body having a first chamber and a second chamber, wherein said first chamber includes a plurality of spaced apertures extending radially through said tubular body and oriented at an angle of approximately 45 degrees to a longitudinal axis of said muzzle, and wherein said second chamber includes at least one longitudinally extending slot.

10. The machine gun of claim 7 wherein said first and second firing mechanisms each further comprise:

a striker pin secured to said striker block; block in one direction; and, wherein said sear lever when in contact with said striker block prevents a motion of said striker block in said one direction.

11. The machine gun of claim 7 further comprising a second control mechanism located in said body for adapting the machine gun for selective automatic and semi-automatic operation, said second control mechanism comprising:

a slidable selector mounted on said body and including an upstanding arm portion which can, at one position, contact said trigger body lever portion causing a pivoting motion thereof against the bias of said biasing means; and, a lock means for selectively releasably locking said slidable selector in a desired position.

12. The machine gun of claim 7 further comprising first and second loading mechanisms for loading ammunition from said magazines into a respective one of said first and second barrels.

13. The machine gun of claim 12 further comprising an operating handle for moving said bullet receiver block in a direction opposite said one direction.

14. A firearm which is balanced in weight, comprising:

a body including a hollow handle and a hollow forward grip longitudinally spaced from said handle;

first and second barrels secured to said body;

first and second firing mechanisms located in said body and in operative connection with said first and second barrels, respectively; and, first and second magazines selectively secured to said body for supplying ammunition to said first and second firing mechanisms respectively, wherein said first magazine is selectively securable in said handle and said second magazine is selectively securable in said forward grip so that said magazines are longitudinally spaced along said body.

15. The firearm of claim 14 wherein said first and second barrels are vertically aligned.

16. The firearm of claim 14 wherein said first barrel is substantially longer than said second barrel.

17. The firearm of claim 14 further comprising a trigger mechanism located in said body, wherein said first and second firing mechanisms are located adjacent opposing end of said trigger mechanism.

18. The firearm of claim 14 further comprising:

a first sight provided on said first barrel, said first sight including a sight body having an aperture extending therethrough; and, a second sight pivotally mounted on said body, wherein said second sight includes a first body having a central aperture therethrough and a second body having a central aperture therethrough, said second sight body being integral with said first sight body and extending substantially at a right angle thereto, said first and second bodies being adapted to use at different distances, wherein said second sight can be pivoted between said first and second bodies as desired.

19. The firearm of claim 18 wherein said second sight first and second bodies each further comprises a plurality of spaced side apertures located around said central aperture.

* * * * *